United States Patent [19]

Ingersoll et al.

[11] 4,351,448

[45] Sep. 28, 1982

[54] PACKAGING CONTAINER FOR MINING AND CONSTRUCTION TOOLS

[75] Inventors: Brian E. Ingersoll, Marietta; Ross C. Nicholson, Stone Mountain; James W. Dennisson, Atlanta, all of Ga.

[73] Assignee: General Electric Company, Detroit, Mich.

[21] Appl. No.: 176,589

[22] Filed: Aug. 8, 1980

[51] Int. Cl.[3] ..... B65D 45/04; B65D 21/02; B65D 25/32

[52] U.S. Cl. ..... 220/318; 206/508; 206/518; 220/91

[58] Field of Search ..... 220/318, 91; 206/508, 206/505, 507, 518

[56] References Cited

U.S. PATENT DOCUMENTS

| | | | |
|---|---|---|---|
| 1,312,626 | 8/1919 | Grannis | 220/318 |
| 2,123,126 | 7/1938 | Urech | 220/318 |
| 2,320,174 | 5/1943 | Demers | 220/318 |
| 3,270,913 | 9/1966 | Bridenstine | 206/507 |
| 3,331,529 | 7/1967 | Slapnik | 206/508 |
| 3,383,009 | 5/1968 | Weikert | 206/508 |
| 3,547,309 | 12/1970 | Parsey | 206/507 |
| 3,586,200 | 6/1971 | Kramer | 220/91 |

FOREIGN PATENT DOCUMENTS

| | | | |
|---|---|---|---|
| 71846 | 5/1916 | Austria | 220/318 |

*Primary Examiner*—George E. Lowrance

*Attorney, Agent, or Firm*—Hedman, Casella, Gibson & Costigan

[57] ABSTRACT

A heavy duty packaging container for tools includes a body portion having an open end, a closed base, a front wall, a back wall, and a pair of opposed sidewalls. The body has a pair of cover engagement members each having a cutout portion, each being fixedly attached to one of the sidewalls. The body includes a pair of handle support members attached to the cover engagement members. The container has a cover which is hingedly connected to the body portion. The cover has a pair of peg members, attached to the cover sidewalls. Each peg is receivable in one of the cover engagement member portions. There is a generally "U" shaped handle having a grip portion and a pair of arm portions. Each arm portion has an aperture for receiving one of the handle support members. Each of the handle arms includes an annular flange which is pivotally mounted over one of the handle support members so as to cooperate with the cover engagement member associated with each handle support member. Each annular flange has a slot portion such that when the handle is in a first position, one of the cover pegs may be received in each cover engagement member cutout, and such that when the handle is pivoted to a second position, each annular flange overlies its associated cover engagement member cutout portion so as to enclose the respective peg received therein, thus locking the container cover to the container body.

10 Claims, 15 Drawing Figures

PACKAGING CONTAINER FOR MINING AND CONSTRUCTION TOOLS

BACKGROUND OF THE INVENTION

The present invention relates to packaging and shipping containers, and more particularly to heavy duty containers for packaging and shipping mining and construction tools.

It will be appreciated that such tools used in the mining and construction industries must be realtively heavy and dense articles to effectively cut through rock and rock-like substances. Accordingly, the containers for their packaging and shipping must be of heavy duty construction to withstand the stresses and strains encountered in transporting the tools. In an attempt to provide the required strength, packaging containers in common use today are generally made either from metal or a heavy duty plastic. It has been found, however, that despite the relatively high strength of the materials used to form known containers, said containers still exhibit undesirable weaknesses.

A significant weakness associated with known packaging containers relates to the fact that they generally open on their longest dimension to facilitate manufacture. More particularly, it has been found that the internal stresses and external strains to which the loaded container is subjected during transit and handling act on the container so as to distort it along its loading, i.e. longest dimension. At the very least, this distortion makes it difficult to open or close the container. Of course, when the stresses are sufficiently great, the container fails resulting in loss of contents. It will be noted that this distortion and/or failure is found both in metal and plastic containers.

Accordingly, it is an object of the present invention to provide an improved packaging container for mining and construction tools which is relatively lightweight, yet very resistant to distortion or failure.

SUMMARY OF THE INVENTION

In accordance with the above recited objectives, the present invention provides a heavy duty container for packaging mining and construction tools, the container being generally rectangular in cross-section and having a body portion, a hingedly connected cover portion and a pivotally mounted container locking handle portion. Preferably, the container is formed from a heavy duty moldable plastic material such as polypropylene. The body of the container includes an open end portion, a closed base, front and back walls and a pair of opposed side walls. Preferably, the container's front and back walls and each of the side walls includes a central recessed portion extending from the open end of the container body towards the base portion thereof so as to provide the container body, in effect, with reinforcement corrugations. In addition, it is preferable that each recessed portion decrease in depth along its length from the open end of the container body towards the base and that the overall container body taper from its open end to its base. The body portion of the container further includes a pair of cover engagement members each of which being fixedly attached to one of the body side walls. Preferably, each engagement member is disposed within the recessed portion of its respective side wall, adjacent to the open end of the container body. In addition, each cover engagement. member includes a cutout for receiving a portion of the container cover. The container body further includes a pair of handle support members each of which being fixedly attached to one of the cover engagement members, and a pair of spaced apart tab members which are disposed on the front wall of the container body adjacent the open end thereof. Preferably, each handle support member is substantially convex in configuration.

The cover member of the subject container includes a central planar portion, opposed front and back walls, and a pair of opposed side walls. Preferably, each of the cover side walls includes a central recessed portion conforming in configuration to the recessed portions of the body side walls such that the cover can readily close over the open end of the container body. In addition, it is preferable that the cover planar portion be recessed from the cover wall members so as to define a raised peripheral lip which provides the container with structural strength and resistance to distortion, and facilitates the stacking of containers. The cover further includes a pair of peg members each of which being fixedly attached to one of the cover side walls, and disposed within the recessed portion thereof. Each peg portion is configured so as to be receivable in the cut-out of its associated cover engagement member when the cover is closed over the container body. In addition, the cover includes a pair of spaced apart hingedly connected flap members, each flap member having an aperture for receiving one of the body portion tab members when the cover is closed over the container body. Preferably, there is a resistance fit between the cover flap apertures and the container body tabs. Of course, a single flap member having two spaced apart apertures for receiving the body tab members may also be used.

The handle member of the subject container is generally "U" shaped in configuration and is pivotally mounted at each end thereof onto one of the handle support members of the container body. More particularly, each end or arm of the handle member includes a through aperture wherein one of the handle support members is received. Each handle aperture includes a reduced diameter portion which defines a wall within the aperture, the reduced diameter portion having a diameter less than that of its associated handle support member. Preferably, the reduced diameter portion is generally concave in configuration. The remaining portion of each handle aperture has a diameter greater than that of its associated handle support member. Each handle member further includes an annular, and preferably substantially concave flange portion which is disposed on the inner side of the handle so as to engage a handle support member. Each annular flange includes a slot portion. In assembling the handle to the container body, the handle support members are distorted so as to be able to pass beyond the reduced diameter portion of its associated handle aperture. Once each handle support member has passed to the area of greater diameter in the handle end aperture, the handle support member resumes its original configuration within the handle aperture. The convex configuration of the handle support members along with the concave configuration of the handle flange portions, facilitates the cooperation and engagement of said elements with one another. Because the reduced diameter portion has a diameter less than that of the handle support member, the handle connot be detached from the container body. Because the remaining portion of the handle aperture has a diameter greater than that of the handle support member, the handle member is freely pivotable.

The subject container is designed such that when the handle member is in a first position, the cover may be closed over the container body with the cover peg portions being received in their respective cover engagement member cut-outs. When the handle member is rotated to a second position, the annular flange portion at each end thereof covers each cover peg portion so as to lock the cover to the container body. When the handle is completely rotated over the container cover flaps, it serves to retain the flaps onto their respective body tabs and to keep the front portion of the container closed.

DETAILED DESCRIPTION OF THE PREFERRED EMBODIMENTS

Figure 1:
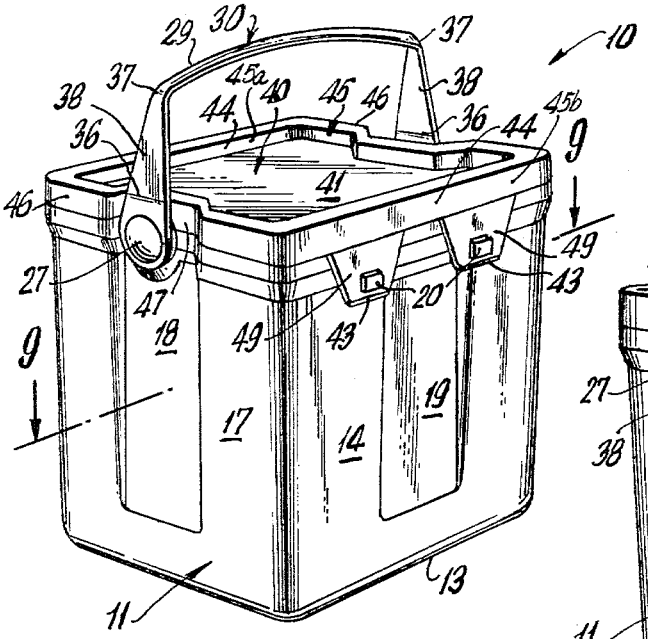
FIG. 1 is a perspective view of a closed container of the present invention.

Referring to FIGS. 1–4 and 6 and 8, the packaging container 10 of the present invention includes a body portion 11, a cover member 40 which is hingedly connected to body portion 11, and a container locking handle member 30. Preferably, the container is made from a moldable plastic material, typically, a polyolefin copolymer such as polypropylene. As illustrated most clearly in FIG. 8, cover member 40 is hingedly connected to container body back wall 15 by means of hinge member 51.

Referring again to FIGS. 1–4 and 6 and 8, body portion 11 includes an open end 12 having an open edge portion 26, a closed base portion 13, a front wall 14, a back wall 15 and a pair of opposed sidewalls 17. Container body 11 also includes a pair of spaced apart tab members 20 which are disposed on front wall 14, adjacent open end 12 of the container, and a peripheral shoulder portion 22 for engaging edge portion 42 of cover 40 when the container is closed. It will be noted that while hinge 51 is illustrated as being unitary with back wall 15 and cover 40, it will be understood that a separate hinge member may also be used.

As illustrated in the Figures, container 10 is generally rectangular in cross section, and in accordance with the invention, open end portion 12 is defined by the length L and width W of the container. Thus, container 10 is adapted to be opened along its two shortest dimensions (L and W) and end loaded into its longest dimension, i.e. container depth d. In the preferred embodiment of the invention, container 10 while tapering slightly from cover 40 to base 13, is generally cubic in configuration such that the cover base, and wall members 14, 15 and 17 each have substantially the same surface area.

Figure 9:
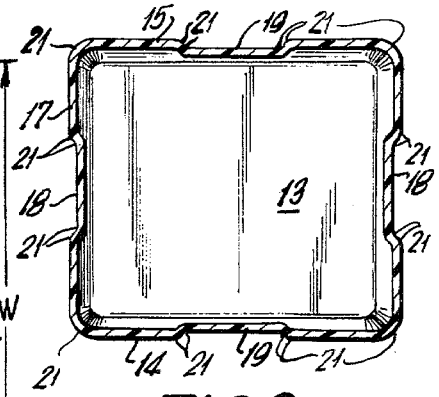
FIG. 9 is a cross-sectional view of the container of the present invention taken along line 9—9 of FIG. 1.
Figure 5:
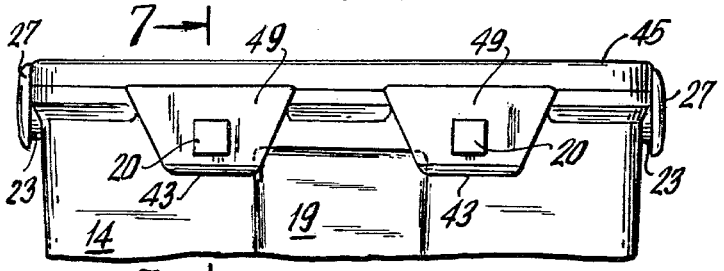
FIG. 5 is a partial elevational view of a closed container of the present invention.

Referring still to FIGS. 1–6 and 8, each container sidewall 17 preferably includes a central recessed portion 18 which extends from open end 12 towards base 13, each recess 18 decreasing in depth along its length from open end 12 towards base 13. In addition, it is also preferable that front and back walls 14 and 15 include recesses 19 which decrease in depth from the recess end adjacent open end portion 12 towards base portion 13. Thus referring to FIGS. 4 and 9, while the overall container 10 is generally rectangular in cross-section, recesses 18 and 19 provide container body 11, in effect, with on the order of twenty corrugations or support points 21, which serve several purposes. More particularly, recesses 18 and 19 and support points 21 defined thereby, provide the container body wall members 14, 15 and 17 with sufficient strength such that loaded containers may be stacked one over the other without relying on each container's contents for support. In addition, recesses 18 and 19 provide means whereby the container wall members are bulgeable so as to maintain the generally rectangular cross-section of the container while the container is being filled with tools and enable the container cover to be readily closed over the container body. For increased strength, container body 11 may be formed such that support points 21 have a greater thickness than the other portions of the container body, with each support point 21 preferably having the smallest possible radius of curvature. In addition, container wall members 14, 15 and 17 may be slightly concave in configuration to further compensate for the bulging thereof during container filling, and said wall members may preferably include a shoulder portion 22, adjacent open edge portion 26, for engaging a portion of container cover 40.

Turning now to FIGS. 4 and 10–15, container body portion 11 further includes a pair of cover engagement members 23, each member 23 being fixedly attached to a container side wall 17, adjacent open end portion 12, and having a cut-out portion 24. Preferably, each cover engagement member 23 is disposed within the central recessed portion 18 of its respective side wall. Body portion 11 further includes a pair of handle support members 27, each of which being fixedly attached to and preferably unitary with a cover engagement member 23. In accordance with the invention it is preferable that container recessed portions 18 have such a depth that each cover engagement member-handle support member combination (23–27) is substantially covered on three sides (see FIG. 4), and that members 27 be generally convex in configuration.

Referring to FIGS. 1–4 and 8, cover member 40 of the subject container includes a planar portion 41, front and back walls 44, and opposed side wall members 46. Preferably, each cover sidewall 46 includes a recessed portion 47 which substantially conforms in configuration to recessed portions 18 of the container body sidewalls. In addition, it is preferable that the depth of each recess 47 decrease along its length such that the combined recess formed by each associated cover and body recess 47 and 18, when cover 40 is closed over container body 11, smoothly decrease in length from container cover 40 towards the container base 13. This permits cover 40 to snugly fit over container body 11.

Figure 3:
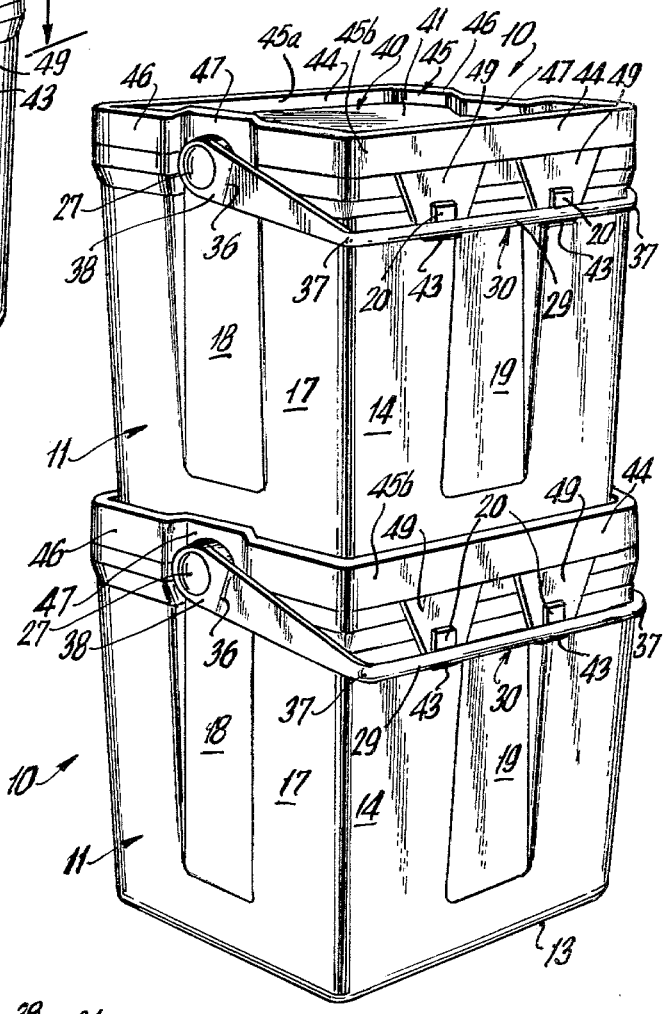
FIG. 3 is a perspective view of a pair of stacked containers of the present invention.
Figure 7:
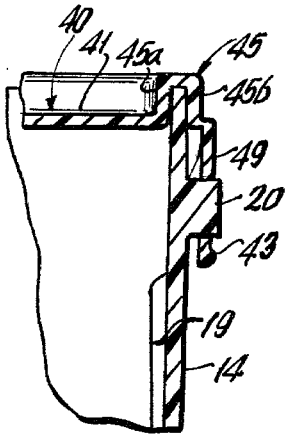
FIG. 7 is a partial cross-sectional view of the container of the present invention taken along line 7—7 of FIG. 5.
Figure 6:
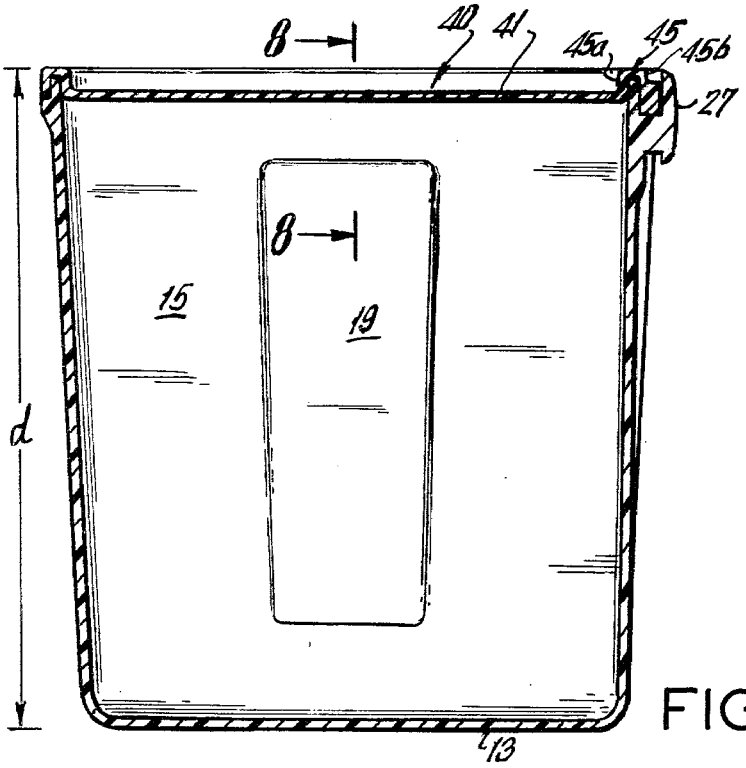
FIG. 6 is a cross-sectional view of the container of the present invention taken along line 6—6 of FIG. 4.
Figure 8:
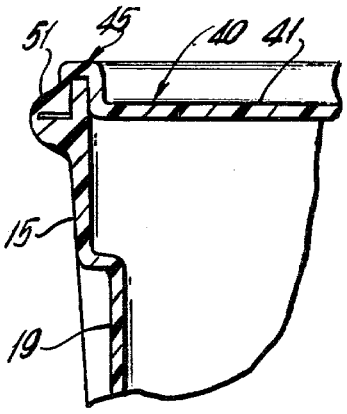
FIG. 8 is a partial cross-sectional view of the container of the present invention taken along line 8—8 of FIG. 6.
Figure 10:
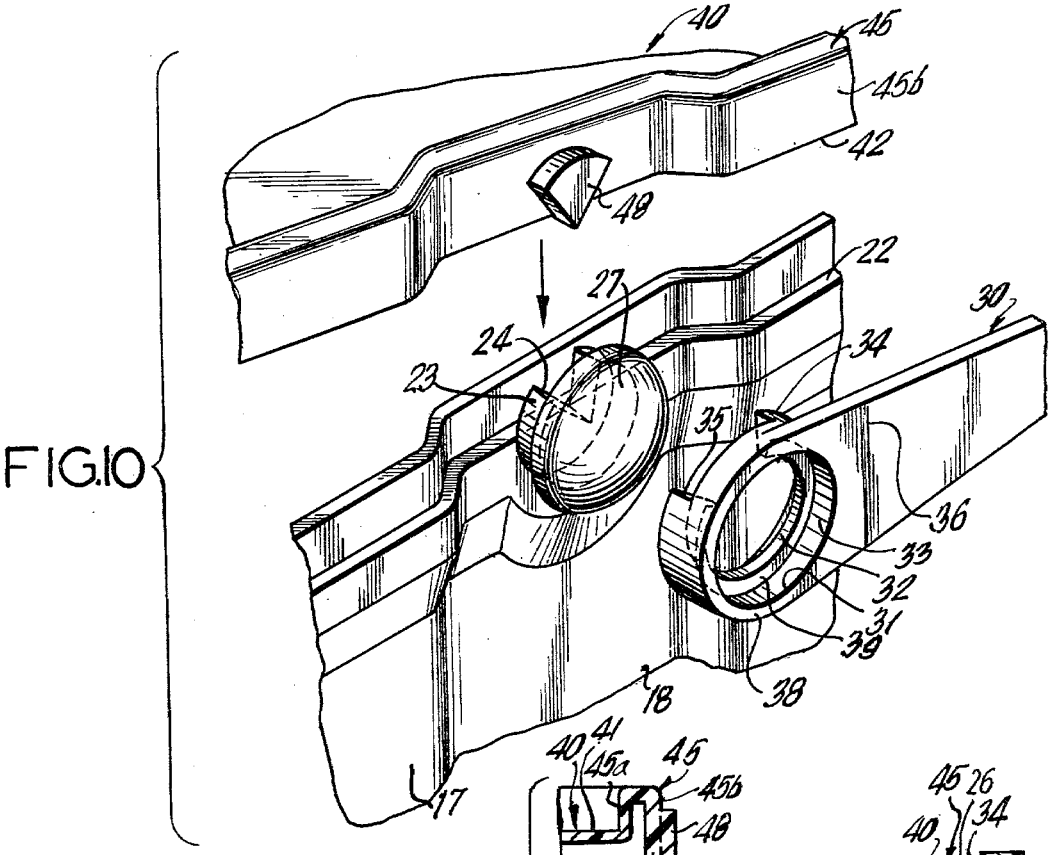
FIG. 10 is a partial exploded perspective view of the container of the present invention illustrating the handle mechanism thereof.

It will be noted that cover planar portion 41 is recessed from its respective front and back walls 44 and side walls 46 so as to form a raised peripheral lip portion 45 having an inner wall portion 45A and a spaced apart outer wall portion 45B. When the container is closed, open end edge portion 26 fits into the space between inner and outer lip walls 45A and 45B, and cover edge portion 42 engages body shoulder 22. Recessed planar portion 41 and peripheral lip 45 combine to serve several purposes. First, as shown in FIG. 3, the fact that cover planar portion 41 is recessed permits the base portion of one container to be received on the cover portion of another container such that the containers may be easily stacked. The above mentioned snug fit effected between cover 40 and container body 11 decreases the risk that stacked containers will topple during transit especially over the rough terrain typically found near mining and construction sites. In addition, the provision of recessed cover planar poriton 41 and lip 45 provide the subject container with increased strength and resistance to distortion. Referring to FIGS. 6–8, cover planar portion 41 is, in effect, suspended from peripheral lip 45 with lip inner wall 45A being spaced from lip outer wall 45B. Thus, a certain amount of distortion due to shear stress and diagonal and lateral impacts may be tolerated before such stress has an effect on lip outer wall 45B. As a result, the risk that cover 40 may become dislodged from container body edge portion 26 is reduced. In addition, the suspension of cover planar portion 41 acts to lessen contents impact from loose tools striking cover 40 from inside the container, and tends to cushion such impact by isolating the resulting contents impact distortion to cover planar portion 41 alone. Further, the fact that the material from which the container is formed is, in effect doubled at lip 45 by the provision of lip inner and outer walls 45A and 45B also adds to the strength of the container.

Cover member 40 also includes a pair of peg members 48 each of which being disposed on one of the cover sidewalls 46, and preferably within the recess portion 47 of each sidewall. Each peg 48 substantially conforms in configuration to that of cutouts 24 of cover engagement members 23 so as to be receivable in said cutouts. The function of pegs 48 will be described below.

Cover member 40 further includes a pair of spaced apart flap members 49 (see FIGS. 1–3, 5 & 7) which are hingedly connected to cover front wall member 44, each flap 49 having an aperture 50 for receiving a body tab portion 20 when cover 40 is closed over the container. Preferably, there is a resistance fit between each tab 20 and aperture 50. It is also preferable that each flap member 49 overlap recess 19 so that a person may easily reach under a flap to open same. It will be noted that while the drawings illustrate the subject container as having two flaps 49, said flaps may be replaced by a single flap which extends substantially across container having an aperture 50 for receiving a body tab portion 20 when cover 40 is closed over the container. Preferably, there is a resistance fit between each tab 20 and aperture 50 and each flap member 49 overlaps recess 19 so that a person may easily reach under a flap to open same. It will be noted that while the drawings illustrate the subject container as having two flaps 49, said flaps may be replaced by a single flap which extends substantially across the width of container face 14. It will be further noted that in the preferred embodiment of the invention each cover flap member 49 also includes a lip portion 43, which as illustrated in FIG. 3, combines wtih container body tab portions 20 to hold the container handle member 30 in position and keep flaps 49 closed.

Referring now to FIGS. 1–3 and 10–15, the handle member 30 of the subject container is generally "U" shaped in configuration, having a gripping portion 29 and a pair of end portions 38, handle 30 being pivotally mounted at each end 38 thereof onto one of the handle support members 27 of the container body. More particularly, each end 38 of handle member 30 includes through aperture 31 for receiving a handle support member 27. Each aperture 31 includes a reduced diameter portion 32 which has a diameter less than that of its associated handle support member 27 and is preferably concave in configuration. The remaining portion 33 of each aperture has a diameter greater than that of its associated handle support member 31, such that reduced diameter portion 32 defines a wall 39 within each aperture (see FIG. 10). Each handle end 38 also includes an annular flange protion 34 which is disposed on the inner portion of the handle for cooperating with a handle cover engagement member. Each annular flange 34 includes a slot portion 35. In assembling handle 30 to container body 11, each handle support member 27 is distorted so as to be able to pass beyond reduced diameter portion 32 of its associated handle aperture. After each member 27 has passed to the area of greater diameter 33 in aperture 31, it resumes its original configuration within the handle aperture. The cooperation between convex handle support member 27 and concave reduced diameter portion 32 of handle aperture 31 facilitate the assembling of handle 32 to container body 11. Because reduced diameter portion 32 has a diameter less than that of handle support member 27, wall member 39 prevents member 27 from disengaging from the handle aperture. In addition, because each handle support member 27 is disposed within the area of greater diameter 33 of its respective handle aperture, the handle is freely pivotable. It will be noted that because each of the subject handle locking mechanisms (which comprise a handle engagement member 23, handle support member 27, and handle end 38) is disposed within a container sidewall recess 18 (see FIGS. 1–4) said mechanism is protected on substantially three sides. In addition, such a construction provides for minimal lateral spacing between containers for efficient storage and shipping.

Referring to FIGS. 1–3 and 10, the subject handle member 30 also preferably includes a pair of score lines 36, each of which being disposed on one of the handle ends 38. In addition, it is preferable that handle 30 includes a pair of reduced thickness portions 37, each being disposed at one end of handle grip portion 29, which along with score lines 36, enable handle 30 to be bent laterally towards either sidewall 17. This provision helps reduce the effect of side stresses on the handle when it is in the closed carrying position (see FIG. 11).

Figure 2:
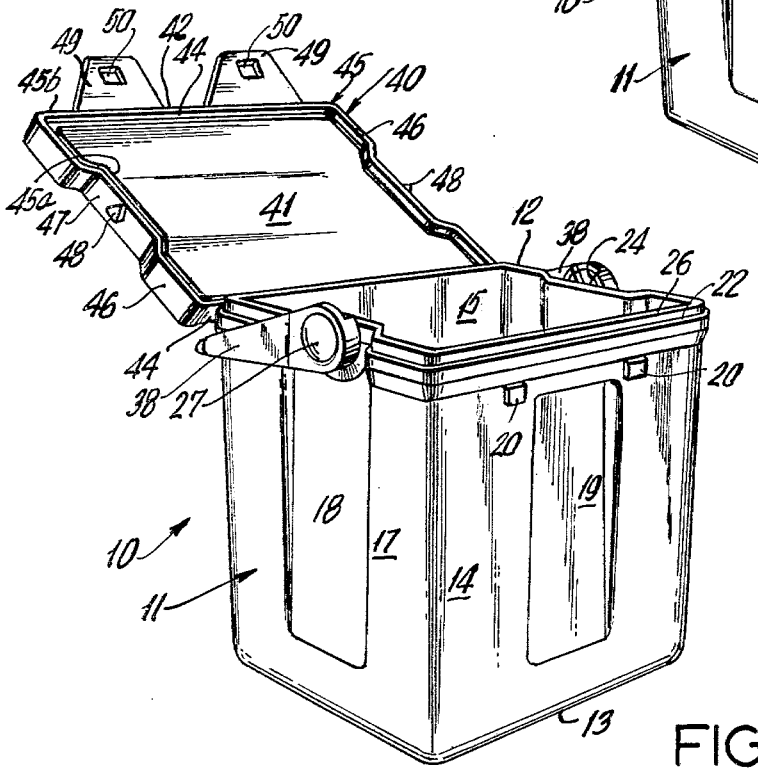
FIG. 2 is a perspective view of an opened container of the present invention.
Figure 4:
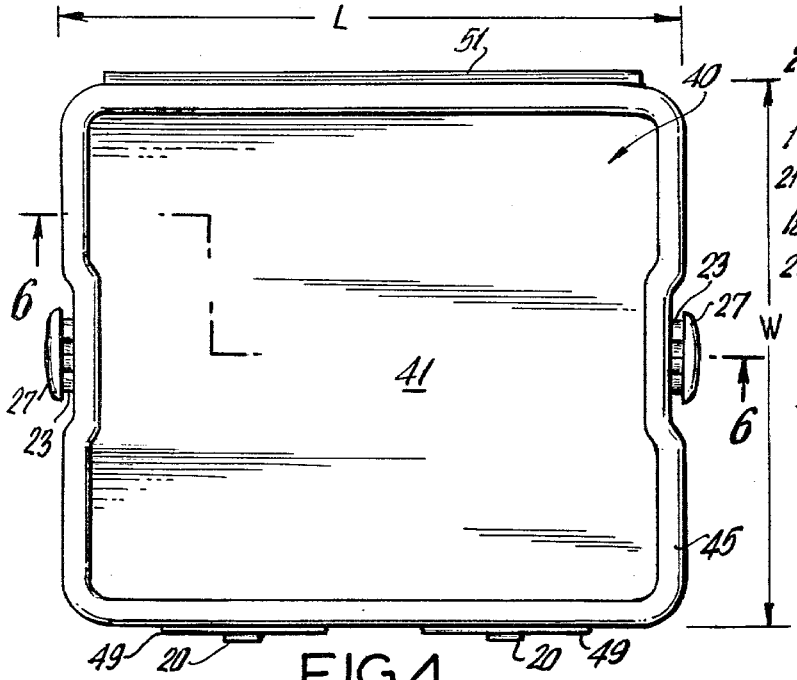
FIG. 4 is a plan view of a closed container of the present invention.
Figure 14:
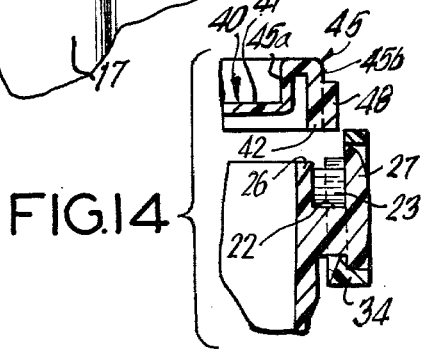
FIG. 14 is a partial cross-sectional view of the container of the present invention taken along line 14—14 of FIG. 11.
Figure 15:
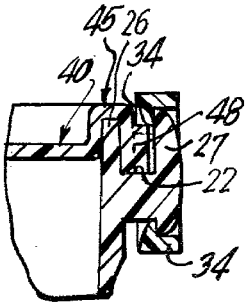
FIG. 15 is a partial cross-sectional view of the container of the present invention taken along line 15—15 of FIG. 13.
Figure 11:
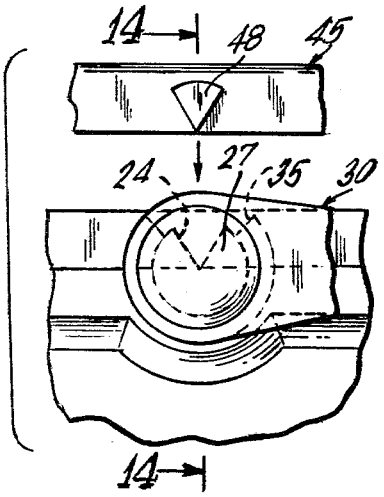
FIGS. 11–13 are partial elevational views of the container of the present invention illustrating the locking of the container cover to the container body.
Figure 12:
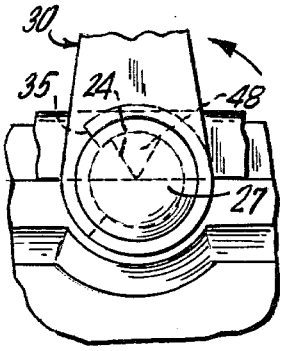
Figure 13:
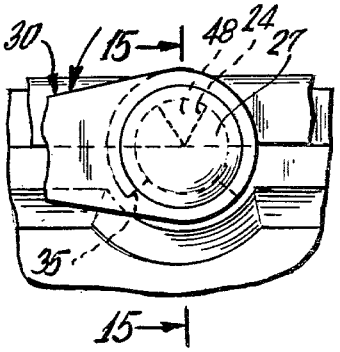

Referring to FIGS. 1–3 and 11–15, the locking mechanism of the subject container is illustrated. Turning specifically to FIGS. 2, 11 and 14, it will be noted that with handle 30 in a first position, i.e., with handle grip portion 29 disposed adjacent container body back wall 15, cover engagement cutout portions 24 are in an open position and handle slots 35 are aligned therewith for receiving cover peg portions 48 when cover 40 is closed over container body 11. Referring to FIGS. 1, 12 and 15, when handle 30 is disposed in a second position, e.g., the upright position, it will be noted that handle 30 has been pivoted such that handle slots 35 are no longer aligned with cover engagement cutouts 24, and moreover, that handle annular flange portions 34 now overlie cutouts 24 and prevent pegs 48 from being lifted out of the cutouts, thus locking cover 40 to container body 11. Referring to FIGS. 3 and 13, when handle 30 is disposed in a third position, e.g. with handle grip portion 29 adjacent container body front wall 14 and disposed between body tabs 20 and cover flap lips 43, cover flaps 49 and the front portion of the container are kept closed.

Referring to FIGS. 1–3, it will be noted that the design of the subject container makes it readily adaptable for automatic loading. More particularly, the containers may be fed in an open upright position to a loading station and easily closed and locked by pivoting the handle in one motion from a position adjacent container back wall 15 to a position adjacent container front wall 14. The pivoting motion of the handle effects the closing of the container cover and the complete locking thereof on all sides, as described above.

In summary, the present invention provides a new and improved packaging container for heavy duty tools such as construction and mining tools. The subject container, is very resistant to the high stresses typically encountered in transporting the tools and the distortion and/or failure generally associated therewith. The container is constructed such that it opens along its two shortest dimensions (L and W) and may be end loaded into its longest dimension, i.e. container depth d. Thus, the portions of the container most vulnerable to distortion are reinforced by the molded intersections of the container. When the subject container is in the closed state (see FIGS. 3 and 8), it exhibits increased perimeter distortion resistance by the provision of hinge member 51 which acts as a molded intersection, locked cover peg members 48, closed flap members 49, and handle member 30 which, in effect, frames the container on substantially three sides. The raised peripheral lip of the subject container cover also provides the container with increased structural strength and resistance to distortion, and enables the containers to be stacked one above the other thus facilitating storage and shipping. The subject container includes a locking mechanism which securely closes the container cover over the container body on all four sides thereof, and which enables the container to be easily adapted to automatic package filling equipment.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A packaging container for tools comprising:

a body portion having an open end portion, a closed base portion, a front wall, a back wall, and a pair of opposed side walls, said front wall, said back wall and said pair of opposed side walls each including a central recessed portion, the depth of each said central recessed portion decreasing along its length from the open end of the container towards the base portion thereof, said body portion further including a pair of substantially cylindrical cover engagement members, one said cover engagement member being fixedly attached to the central recessed portion of one said side wall and the other cover engagement member being fixedly attached to the central recessed portion of the opposite side wall, each of said cover engagement members including a cutout portion, said body portion further including a pair of handle support members, each of which being fixedly attached to one of said cover engagement members, said front wall of said body portion including at least one tab member fixedly attached thereto;

a cover member for covering the open end of said body portion, said cover member having a planar portion and a front wall, a back wall and a pair of opposed side walls enclosing said planar portion, the back wall of said cover member being hingedly connected to the back wall of said body portion, said cover member including a pair of peg members, one said peg member being fixedly attached to one of said opposed cover side walls and the other said peg member being fixedly attached to the other cover side wall, said peg members being configured and located so as to be receivable in the cutout portions of said body portion cover engagement members when said cover member is closed over said container body, said cover member further including at least one flap member hingedly connected to the front wall of said cover member, each said at least one flap member having an aperture aligned with one of said at least one tab member on said body portion such that each said aperture can resistably engage its associated tab member, said at least one flap member being dimensioned to extend partially over said central recess portion of said front wall when the container cover is closed; and a generally U-shaped handle member having a grip portion and a pair of arm portions, each of said arm portions having an aperture for receiving one of said handle support members, each of said apertures including a reduced diameter portion having a diameter less than that of its associated handle support member and defining an annular wall member within each said aperture, the remaining portion of each said aperture having a diameter greater than that of its associated handle support member, each handle support member being disposed in the portion of greater diameter of its respective handle arm aperture such that said handle may pivot around said handle support members, each of said handle arm portions further including an annular flange member pivotally mounted over one of said handle support members so as to cooperate with the cover engagement member associated with each said one handle support member, each of said annular flange members having a slot portion, such that when said handle member is in a first position, each of said slot portions is substantially aligned with the cutout portion of its associated cover engagement member such that one of said cover peg members may be received in each said cutout portion, and such that when said handle member is pivoted to a second position, each said annular flange member overlies its associated cover engagement cutout portion so as to enclose the respective cover peg member received therein, thus securing said container cover to said container body and enabling the closed container to be carried by said handle, and such that when said handle is pivoted to a third position, said handle engages said at least one tab member securing each said at least one flap on its respective tab member, thereby redundantly locking said cover member to said body portion and securing said container for storing and shipping.

2. A packaging container as in claim 1 wherein the planar portion of said cover member is recessed from its respective wall members so as to define a raised peripheral lip member having an inner wall member and a spaced apart outer wall member.

3. A packaging container as in claim 1 wherein each of the sidewalls of said cover member includes a recessed portion, each of said recessed portion substantially conforming in configuration with the recessed portion of its associated body sidewall.

4. A packaging container as in claim 1 wherein each of said handle arm members includes a score line, and each end of said handle grip portion includes an area of reduced thickness such that said handle member may be laterally bent towards either container body sidewall.

5. A packaging container as in claim 1 which is of unitary construction and molded from a plastic material.

6. A packaging container as in claim 5 wherein the container is formed from a polyolefin copolymer.

7. A packaging container as in claim 1 in which each said at least one cover flap member includes a lip portion such that when each said at least one flap member is closed over its associated body tab member, each said tab member and the lip portion of its associated flap member defines a space therebetween for resistively receiving the grip portion of the container handle.

8. A packaging container as in claim 1 wherein the longest dimension of the container is along the container depth and said open end portion is defined by the two shortest dimensions of the container.

9. A unitary packaging container for tools comprising:

a body portion having an open end portion defined by the two shortest dimensions of the container, a closed base portion, a front wall, a back wall, and a pair of opposed side walls, said body portion tapering along its depth from the open end portion thereof to said base portion, said container depth defining the longest dimension of the container, said front wall, said back wall and said opposed side walls each including a central recessed portion extending from said open end portion toward said base portion, each of said body recessed portions decreasing in depth along its length from said open end portion towards said base portion, said body portion further including a pair of spaced apart tab members disposed on said front wall thereof, said body portion further including a pair of substantially cylindrical cover engagement members, one said cover engagement member being fixedly attached to the recessed portion of one of said body side walls and the other said cover engagement member being fixedly attached to the recessed portion of the other said body side wall such that each said cover engagement member is substantially enclosed on three sides, each of said cover engagement members including a wedge shaped cutout portion, said body portion further including a pair of substantially cylindrical handle support members, each of which being fixedly attached to one of said cover engagement members and extending coaxially therefrom, each handle support member having a diameter greater than that of its associated cover engagement member and having its end opposite said cover engagement member convex;

a cover member for covering the open end of said body portion, said cover member being hingedly connected to the back wall of said body portion, said cover member having a planar portion, a front wall, a back wall, and a pair of opposed side walls enclosing said planar portion, said planar portion being recessed from said cover walls so as to define a raised peripheral lip having an inner wall member and a spaced apart outer wall member such that the base of one container may be received within the peripheral lip of the cover of another container for facilitating the stacking of containers, each of said cover side walls having a recessed portion conforming in configuration with the recessed portions of said body side walls so as to be contiguous therewith when the cover is closed over the container body, the recessed portion of each said side wall of said cover member including a wedge shaped peg members fixedly attached thereto, each of said peg members being configured and located so as to be receivable in one of the wedge shaped cutout portions of said body portion cover engagement members when said cover member is closed over said container body, said cover member further including a pair of spaced apart, hingedly connected flap members, each of said flap members having an aperture for receiving one of said body tap members when said container cover is closed over the container body, said flap members being dimensioned to extend partially over said central recessed portion of said front wall when the container cover is closed to facilitate opening of said flap members; and a generally "U" shaped handle member having a grip portion and a pair of arm portions, each of said arm portions having a score line, and each end of said grip portion including an area of reduced thickness such that said handle member may be laterally bent towards either container body side wall, each of said arm portions having an aperture for receiving one of said handle support members, each of said apertures including a reduced diameter portion having a diameter less than that of its associated handle support member and defining an annular wall member within each said aperture, the remaining portion of each said aperture having a diameter greater than that of its associated handle support member, each handle support member being disposed in the portion of greater diameter of its respective handle arm aperture such that said handle may pivot around said handle support members, each of said handle arm portions further including an annular flange member pivotally mounted over said handle support members so as to cooperate with the cover engagement member associated with said one handle support member, each of said annular flange members having a slot portion having a width at least as great as the widest part of each said wedge shaped peg, such that when said handle member is in a first position, each of said slot portions is substantially aligned with the cutout portion of its associated cover engagement member, such that one of said cover peg members may be received in each said cutout portion, and such that when said handle member is pivoted to a second position, each said annular flange overlies its associated cover engagement cutout portion so as to enclose the respective cover peg member received therein thus securing said container cover to said container body and enabling the enclosed container to be carried by said handle and when said handle is pivoted to a third position said handle engages said tab members securing said flaps on said tab members thereby redundantly locking said cover to said base and securing said container for storing and shipping.

10. A packaging container as in claim 9 in which each of said cover flap members includes a lip portion such that when said flap members are closed over their associated body tab members, each tab member and the lip portion of its associated flap member defines a space therebetween for resistively receiving the grip portion of the container handle.

* * * * *